United States Patent [19]

Steinberger

[11] Patent Number: 4,608,904

[45] Date of Patent: Sep. 2, 1986

[54] TUNING SYSTEM FOR STRINGED MUSICAL INSTRUMENT

[75] Inventor: Ned Steinberger, New York, N.Y.

[73] Assignee: Steinberger Sound Corporation, Brooklyn, N.Y.

[21] Appl. No.: 735,723

[22] Filed: May 20, 1985

Related U.S. Application Data

[63] Continuation of Ser. No. 386,326, Jun. 8, 1982, abandoned.

[51] Int. Cl.[4] ..... G10D 3/14

[52] U.S. Cl. ..... 84/304; 84/205; 84/297 R

[58] Field of Search ..... 84/205, 214, 267–269, 84/297–302, 304–307, , 312–314

[56] References Cited

U.S. PATENT DOCUMENTS

| | | | |
|---|---|---|---|
| 418,364 | 12/1889 | Bookser | 84/297 R |
| 459,603 | 9/1891 | Tuebnee | 84/297 R |
| 521,228 | 6/1894 | Bech . | |
| 577,964 | 3/1897 | Mahoney | 84/302 |
| 973,846 | 10/1910 | Bendel | 84/297 R |
| 2,070,916 | 8/1935 | Peate . | |
| 2,130,248 | 9/1938 | Peate | 84/297 R |
| 2,260,049 | 10/1941 | Nickel | 84/297 R |
| 2,523,963 | 9/1950 | Mitchell | 84/267 |
| 2,585,661 | 2/1952 | Kluson | 84/299 |
| 3,048,073 | 8/1962 | Farr | 84/205 |
| 3,407,696 | 9/1967 | Smith et al. . | |
| 3,443,465 | 5/1969 | Kasha | 84/307 X |
| 4,079,652 | 3/1978 | Gittler . | |
| 4,141,271 | 2/1979 | Mullen | 84/312 P |
| 4,175,467 | 11/1979 | Lashley | 84/312 P |
| 4,192,213 | 3/1980 | Steinberger | 84/293 |
| 4,201,108 | 5/1980 | Bunker | 84/1.16 |
| 4,281,576 | 8/1981 | Fender | 84/298 |
| 4,366,740 | 1/1983 | Tripp | 84/298 |

FOREIGN PATENT DOCUMENTS

| | | | |
|---|---|---|---|
| 20912 | of 1900 | United Kingdom | 84/297 R |
| 659299 | 10/1951 | United Kingdom . | |

*Primary Examiner*—Lawrence R. Franklin
*Attorney, Agent, or Firm*—Finnegan, Henderson, Farabow, Garrett & Dunner

[57] ABSTRACT

An anchoring and tuning mechanism for the strings of a stringed musical instrument employing plug-ended strings slidably insertable into slots and cut-outs and tensioned by retraction of anchor members slidable in channels aligned with the strings.

12 Claims, 17 Drawing Figures

FIG. 14
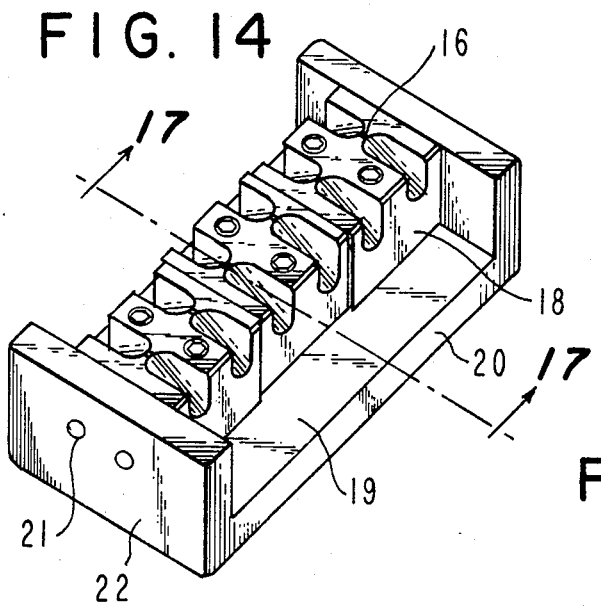
FIG. 12
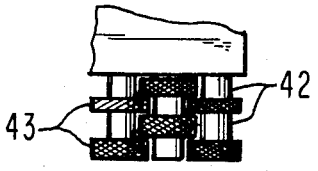
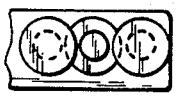
FIG. 13
FIG. 15
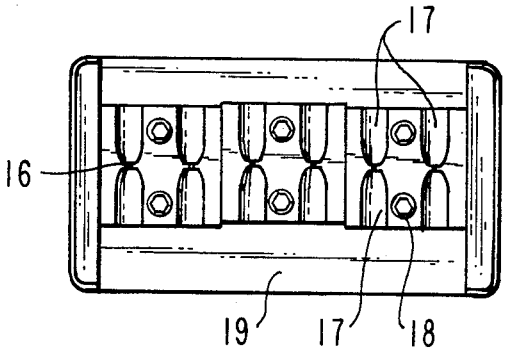
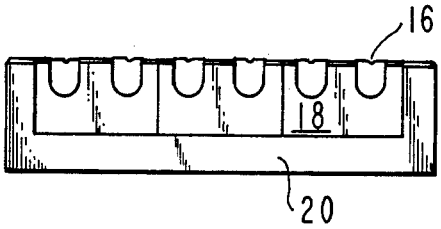
FIG. 16
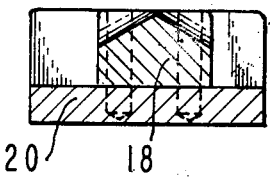
FIG. 17

TUNING SYSTEM FOR STRINGED MUSICAL INSTRUMENT

This application is a continuation of application Ser. No. 386,326, filed June 8, 1982, now abandoned.

BACKGROUND OF THE INVENTION

1. Field of the Invention

The present invention relates to tuning systems for use on stringed musical instruments. More particularly, the present invention relates to a tuning system which facilitates rapid replacement of defective strings and rapid tuning of replacement strings. The present invention will be especially appreciated by professional performing artists and by non-sighted musicians.

2. Description of the Prior Art

One of the best known tuning mechanisms involves securing one end of a string to an anchorage at one end of the instrument and passing the other end of the string through a hole in a rotatable peg and then winding the string around the peg. The peg is rotated until the desired tension is imparted to the string to produce the desired note.

In another conventional anchoring and tuning mechanism strings are knotted at one end and anchored in the grooved end of the fret bar or neck of the instrument. The adjustable portion of such a mechanism usually requires threading the remaining unanchored end of the string over one or more grooved paths and through one or more apertures. The string is commonly held fixed in the adjustable portion of the mechanism by squeezing means or winding means.

Tuning also has been accomplished by passing the free end of a string having a bead at one end through a bore in a cylindrical tuning stud. In this arrangement, the stud has threads on the outer surface thereof for engaging the inner-threaded surface of a tuning nut. The free end of the string is tied at the neck of the instrument and tension in the string is adjusted by turning the tuning nut in a way which draws the threaded tuning stud into the tuning nut. This tuning method requires threading replacement strings through the bore in the tuning stud, through the cylindrical channel, and through the longitudinal slot. The string is then tied with a conventional knot, such as a half-hitch, at the end of the neck of the guitar. The replacement of strings on a guitar employing such tuning mechanisms is far from a simple or quick task.

The use of strings having a loop at each end has also been disclosed in the prior art. In such a system, one end of the string is looped to a hook on a fixed anchorage at the base of the instrument, and the other string end is looped over a hook formed on the end of a slidable screwed rod at the neck. The screwed rod is longitudinally adjustable by an adjusting nut to increase or decrease tension in the string. In such a tuning mechanism the adjustable portion of the tuning mechanism is located at the end of the neck of the instrument, and the string is anchored at the base of the instrument. Replacement of strings in this arrangement is inconvenient, requiring the use of both hands and cannot be done easily by a non-sighted musician.

SUMMARY OF THE INVENTION

It is therefore the principal object of the present invention to provide a tuning system for a stringed musical instrument permitting rapid replacement of defective strings and rapid tuning of replacement strings. The rapidity of string replacement permitted by the present invention minimizes interruptions in professional performances caused by the need to replace defective strings.

It is a further object of this invention to provide a tuning mechanism for stringed musical instruments facilitating replacement of defective strings and tuning of replacement strings with the use of only one hand and without the aid of any sense other than touch. Thus, a blind musician would find the present invention particularly useful.

It is a further object of the present invention to provide a tuning system for stringed musical instruments which maximizes the useful life of the strings by eliminating the possibility that the strings might twist while being tuned.

It is a further object of the invention to improve the tone of a stringed musical instrument.

It is a further object of the present invention to reduce the cost of producing a stringed instrument and permit construction of an instrument which is more convenient to play by the musician and easier to transport and store.

The principal object of the invention is accomplished by an anchoring and tuning mechanism for the strings of a stringed instrument, comprising, a ball fixed to one end of each string, means for securing the other end of each said string, a tuning block for mounting on the instrument adjacent one end of the strings, the block having an individual channel aligned with each string, each channel having two sidewalls and a bottom wall, at least one anchor member positioned in each of the channels, a cut-out in the end of the anchor member closest the string for lateral slidable insertion of the ball, the cutout having an exit slot to permit the string to protrude through the end of the anchor member, means for controllably adjusting the position of each anchor member in its channel for increasing or decreasing the tension in the string, and bridge means mounted on the instrument between the tuning block and the securing means.

The tuning plug is preferably a circular shaped bead having a circumferential groove for receiving the end of the string fastened to the ball. An anchor plug, similarly constructed but preferably of a different sized or shaped bead, is preferably fixed to the end of the string opposite the end having the tuning ball.

The tuning block channels are preferably comprised of first and second opposing sidewalls, the first sidewalls having an end with a guideway for alignment with the cut-out. The second sidewall has a stop opposing the guideway of the first sidewall. The shape of the guideway is preferably a semi-circle.

The adjustable means preferably comprises individual tuning knobs and a threaded bolt fixed on one end of each knob. The threaded bolt is slidably mounted through one end of each tuning block channel and into a tap threaded longitudinally in the anchor member. Turning the knob moves the anchor member longitudinally within the tuning block channel. The tuning knobs preferably are cylindrical and the curved surfaces of the knobs have annular ribs and annular channels permitting adjacent knobs to be interfitted so that manually turning any knob does not cause rotation of either adjacent knob. This arrangement permits reduction of the separation between adjacent bolts for use with instruments having a large number of strings in relation to the size of the instrument.

BRIEF DESCRIPTION OF THE DRAWINGS

FIG. 12 is a partial top view of the tuning knob embodiment suitable for instruments having more than 6 strings;

FIG. 13 is a partial front view of the tuning knob embodiment shown in FIG. 12;

FIG. 14 is a perspective view of the bridge;

FIG. 15 is a top view of the bridge of FIG. 14;

FIG. 16 is a front view of the bridge of FIG. 14;

FIG. 17 is a cross-sectional view taken along line A—A of FIG. 14.

The objects, features and advantages of the present invention will be made apparent by the following detailed description which makes reference to the accompanying drawings.

DESCRIPTION OF THE PREFERRED EMBODIMENTS

In accordance with the invention, the tuning system comprises a ball fixed to one end of each string and means for securing the other end of the string to the instrument. A tuning block is mounted on the instrument adjacent the ball end of the strings. The tuning block has an individual tuning channel aligned with each string. Each tuning channel may have opposing first and second sidewalls and a bottom wall. In each tuning channel is at least one anchor member in close sliding relationship with the sidewalls of the channel. In the end of each anchor member closest the ball end of the string is a cut-out for slidable insertion of the ball. The cut-out has an exit slot to permit the string to protrude unobstructed through the end of the anchor member. The tuning system also includes means for controllably adjusting the longitudinal position of each anchor member in its channel. The adjusting means individually increases or decreases the tension in the corresponding string of the instrument. Also included in the tuning system is a bridge means mounted between the tuning block and the securing means.

Figure 1:
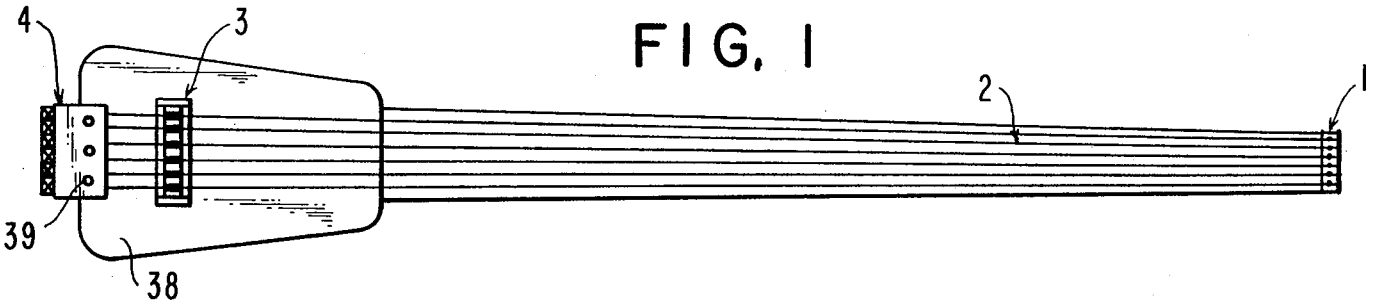
FIG. 1 is a top view of a guitar including an embodiment of the present invention.

As here embodied and as shown in FIG. 1, the tuning system includes string anchorage 1, string 2 beaded at both ends, bridge 3 and adjustable tuning block 4.

Figure 7:
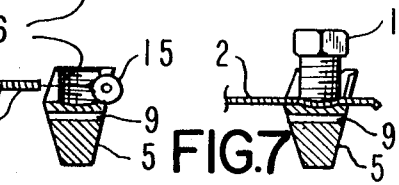
FIG. 7 is a side view of the anchor plate of the present invention showing the anchor bolt screwed into the anchor bore and gripping the string.

As here embodied and as shown in FIGS. 4, 5, 6, 7, 8 and 9, the securing means preferably comprises metal anchor plate 5 having cylindrical anchor bores 6 extending about half the depth of the plate in a direction perpendicular to the string direction. A separate anchor bore 6 is provided for each string of the instrument. Anchor slots 7 extend through plate 5 in a direction parallel to the strings, passing through the center of each anchor bore 6. Counter-sunk attachment bores 8, shown in FIGS. 4 and 9, and provided for mounting string anchorage 1 to the neck of the instrument. Tying bores 9 extend through plate 5 just below each anchor slot 7 and are aligned with the strings. Anchorage counter-sinks 10 are provided on the side of plate 5 opposite the greatest length of the strings and aligned with each anchor slot 7. Each anchor bore 6 may be threaded for receiving threaded anchor screw 11, as shown in FIG. 7. A vacant anchor bore having threads for receiving anchor screw 11 can be seen in FIG. 6.

Figure 2:
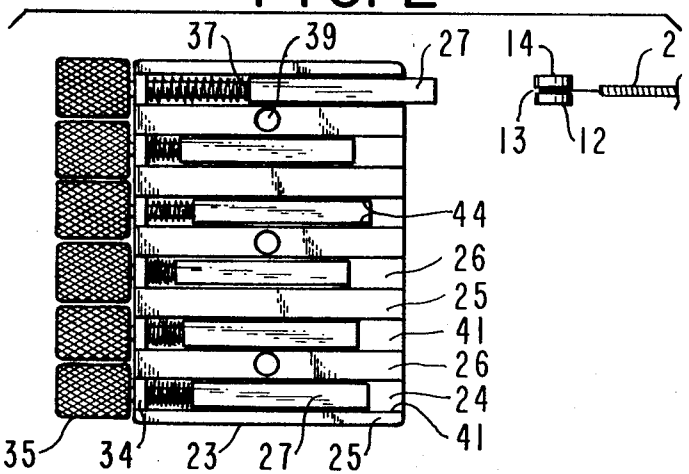
FIG. 2 is a view of the underside of the embodiment of the adjustable tuning block shown in FIG. 1.
Figure 3:
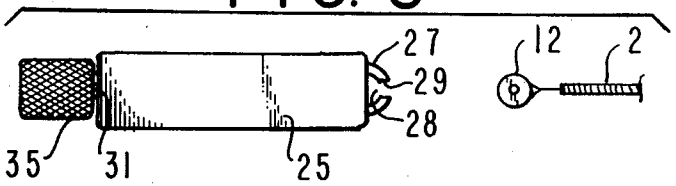
FIG. 3 is a side view of the structure shown in FIG. 1.
Figure 4:
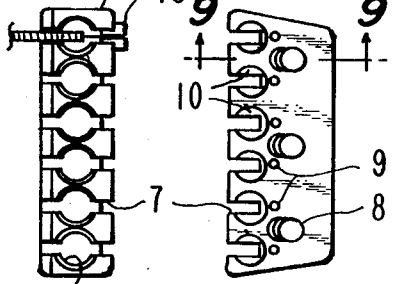
FIG. 4 is a view of the anchor plate of the present invention taken along the side which engages the beaded end of the string.
Figure 5:
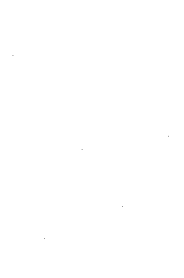
FIG. 5 is a top view of the anchor plate of the present invention.

In accordance with the present invention, each string 2 of the instrument preferably is fixed on both ends to a ball. As embodied herein, circular shaped ball 12 has circumferential groove 13 around the center of cylindrical surface 14 of the ball, as shown in FIGS. 2 and 5. One end of instrument string 2 may be looped around surface 14 in groove 13 before being fastened to itself. A second ball, anchor ball 15, preferably smaller than tuning ball 12, may be fastened to the remaining end of the string in the same fashion as tuning ball 12 is fastened. Anchor balls 15 and tuning balls 12 preferably are of different sizes or shapes to facilitate tactile distinction between them. However, one end of the string may be free of any ball attachments. In this latter embodiment, the end of the string may be anchored to the plate by tying or vising, as hereinafter fully explained.

The string 2 may be anchored in the anchor plate in one of three ways. The first way applies to strings having anchor balls 15 attached to one end. Such strings may be passed through anchor slot 7 until anchor ball 15 rests in corresponding anchorage depression 10. In this embodiment anchor bores 6 need not be drilled, nor need there be threaded anchor screws 11.

In a second embodiment (FIG. 8) suitable for string ends without attached balls, the string 2 may be passed lengthwise through tying bore 9 and secured by tying. To anchor the string using the tying method, the string is looped through anchor slot 7 after having been passed lengthwise through tying bore 9 and is tied to itself in a conventional manner upon exiting anchor slot 7. To anchor the string by vising, the string is passed lengthwise through anchor slot 7 and screw 11 is tightened down into threaded bore 6 until string 2 is vised between the bottom surface of threaded bore 6 and the tip of screw 11, as shown in FIG. 7. The threading interface between screw 11 and threaded anchor bore 6 is such that vibration of string 2 does not cause threaded anchor bolt 11 to unscrew from threaded anchor bore 6.

As here embodied, the bridge means includes string bridge 3, as shown in FIGS. 14, 15, 16 and 17, mounted on the instrument between the tuning block and the string anchorage. Each string passes through bridge notch 16 located at the apex of peaked member 17, as shown in FIG. 16. Bridge blocks 18, having one or two peaked members 17 depending upon the number of strings used by the instrument, are arranged side-by-side in U-shaped channel portion 19 of U-shaped support member 20. Stability means, preferably countersunk screws 21 threaded through one sidewall 22 of U-shaped support member 20 to protrude into blocks 18, are provided to prevent movement of bridge notches 16 in a direction perpendicular to the strings and parallel to the longitudinal direction of screws 21.

Figure 10:
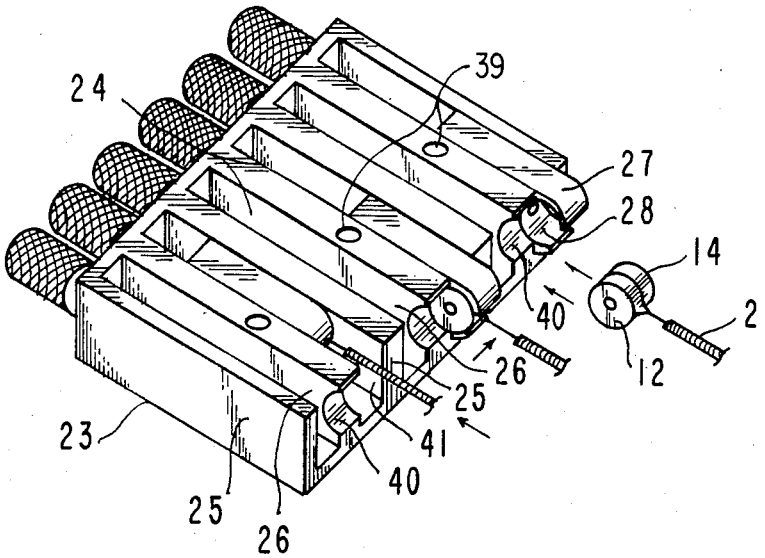
FIG. 10 is a perspective view of the embodiment of the present invention shown in FIG. 2.

In accordance with the present invention, there is provided anchoring and tuning means for adjustably controlling the tension in each string of the instrument. As embodied herein, metal tuning block 23, indicated generally in FIGS. 2 and 10, is provided with separate tuning channels 24 aligned with each string 2 of the instrument. Each tuning channel 24 has first sidewall 25 and second sidewall 26 extending parallel to the longitudinal direction of each string 2 aligned with each channel 24. Individual anchor members 27 are of smaller lengthwise dimension than the lengthwise dimension of channels 24 and fit slidably into each channel 24. Clearance 44, as shown in FIG. 2, between each anchor member 2 and channel sidewalls 25 and 26 is close enough so that anchor members 27 do not wobble as they slide longitudinally back and forth in channels 24. At that end of each anchor member facing the strings as each said anchor member 27 rests in its channel 24, there is provided cut-out 28, shaped to receive insertion of tuning ball 12. The relative dimensions of cut-out 28 and tuning ball 12 are such that tuning ball 12 is snugly, but easily, slidable laterally into cut-out 28. Once inserted into cut-out 28, tuning ball 12 is held so that it cannot rotate about the string axis. There is further provided in the end of each anchor member 27 having cut-out 28, an exit slot 29 which permits the string to protrude unobstructed by anchor member 27 while tuning ball 12 is inserted into cut-out 28. While tuning ball 12 is resting in cut-out 28, no portion of the string comes into contact with anchor member 27 because of the construction of tuning ball 12 with its circumferential groove 13 and the orientation of exit slot 29 in anchor member 27 in relation to string 2. While it is preferred to insert the ball laterally into the cutout 28, the cutout could also be oriented for vertical insertion.

Figure 11:
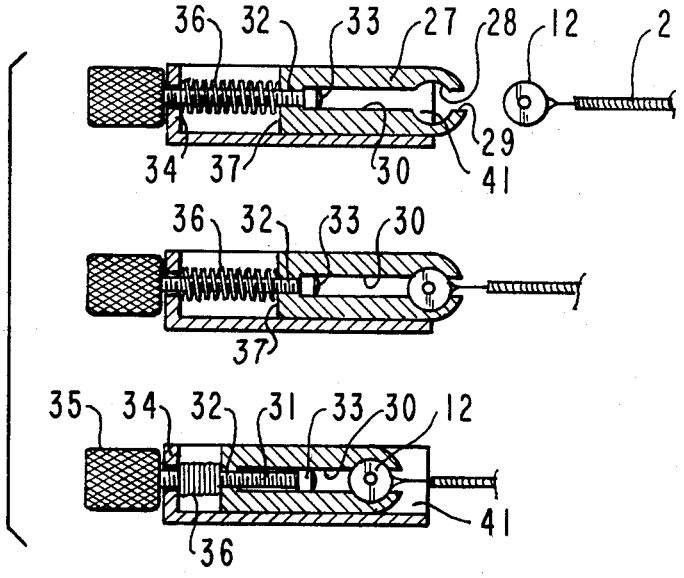
FIG. 11 is a cut-away view of the insertion process shown in FIG. 10.

Extending longitudinally through each anchor member 27, and parallel to aligned string 2, is tuning bore 30 for slidably receiving threaded tuning bolt 31. At that end of tuning bore 30 opposite cut-out 28 is threaded bore 32 for engaging threaded tuning bolt 31. The end of threaded bolt 31 extending into tuning bore 30 is peened, as indicated by the number 33 shown in FIG. 11, for preventing threaded bolt 31 from being completely extracted through threaded bore 32. The diameter of threaded bore 32 is smaller than the diameter of tuning bore 30 and smaller than the diameter of peened end 33 of threaded bolt 31.

The end of threaded bolt 31 opposite the peened end extends slidably through rear wall 34 of tuning block channel 24 and is fixed to tuning knob 35. Knob 35 is preferably a cylindrical knob having a knurled outer cylindrical surface to provide a frictional surface which facilitates manual turning of the knob.

Springs 36 preferably are provided for each individual channel 24 between each rear wall 34 of each channel 24 and each rear surface 37 of each anchor member 27 in order to insure biasing of knobs 35 against rear wall 34 and to maintain the maximum distance between rear wall 34 and surface 37 of anchor member 27 for any given position of anchor member 27 in its corresponding channel 24. This insures that anchor member 27 tends to extend outward to the maximum extent permitted by the relative position of bolt 31 within tuning channel 30 in order to be ready for the slidable insertion or removal of tuning balls 12.

In accordance with the present invention, the end of each second sidewall 26 facing the strings is provided with a guideway 40, and the end of each opposing first sidewall 25 facing the strings is provided with ball stop surface 41. As embodied herein, guideway 40 is shaped to coincide with cut-out 28 in anchor member 27 when said anchor member extends sufficiently out of channel 24 for receiving or removing tuning ball 12. The shape of guideway 40 is preferably semi-circular, as shown in FIG. 10. When tuning ball 12 is to be inserted into cut-out 28, guideway 40 aligns with cut-out 28 in anchor member 27 as anchor member 27 extends out from channel 24 so that tuning ball 12 slides laterally through guideway 40 into cut-out 28 until ball stop surface 41 of opposing first sidewall 25 prevents further lateral insertion of tuning ball 12. The cooperation between guideway 40 and cut-out 28 permits single-handed insertion of tuning ball 12. The further cooperation of ball-stop surface 41, shown in FIGS. 10 and 11, facilitates one-handed insertion of tuning ball 12 by preventing lateral movement of tuning ball 12 completely through cut-out 28. Thus, it can be seen how the cooperation of guideway 40, tuning ball 12, cut-out 28, and ball stop surface 41 cooperate to enable strings to be anchored without the aid of any sense other than the tactile sense of the fingers of a single unassisted hand.

Once tuning ball 12 has been inserted as described above, it is considered anchored. Once tuning ball 12 has been anchored, the string can be tuned, and held in the tuned position, by turning knob 35 so as to move anchor member 27 longitudinally within channel 24 until the string is sufficiently tensioned to yield the desired musical note.

Operation of the anchoring and tuning device of the present invention proceeds as follows. For strings having balls at both ends, the end having the smaller ball is inserted into anchor slot 7 of anchor plate 5 and tensioned so that anchor ball 15 rests against anchorage depression 10 of anchor plate 5. When the strings are properly anchored in the anchor plate, they do not touch the neck of the instrument. Tension is maintained in the string while it is passed through notch 16 of bridge 3. Knob 35 is rotated in the direction which causes anchor member 27 to move away from rear wall 34 of channel 24 until cut-out 28 of anchor member 27 is coincident with guideway 40 so as to expose cut-out 28 sufficiently to slidably receive tuning ball 12. Tuning ball 12 slides laterally through guideway 40 and into cut-out 28 until further lateral movement is prevented by ball stop surface 41 in first sidewall 25 of channel 24.

Tuning knob 35 may then be rotated in a direction which draws anchor member 27 closer to rear wall 34 of channel 24. Tuning knob 35 is turned until string 2 is tensioned sufficiently to yield the desired musical note. The distance between adjacent threads in both bolt 31 and threaded bore 32 is sufficiently small so as to enable fine tuning of the string. Moreover, the diameter of bolt 31 is sufficiently smaller than the diameter of tuning knob 35 so that fine tuning of the strings by manual movement of tuning knob 35 is facilitated.

In an alternative embodiment of the invention employing a string having a tuning ball on one end and no ball on the other end, the string end having the tuning ball is anchored in the tuning block as described above.

Figure 8:
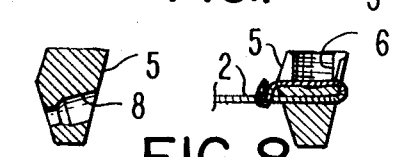
FIG. 8 is a side view of the anchor plate of the present invention showing the string looped through the tying bore and tied.
Figure 9:
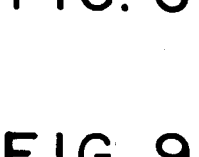
FIG. 9 is a cross-sectional view taken along line A—A of FIG. 4.

The string end having no tuning ball can be anchored in one of two ways. This free end of the string can be passed through tying bore 9 in anchor plate 5 and looped around and returned through anchor slot 7 and tied in a conventional manner upon exiting anchor slot 7, as shown in FIG. 8.

Figure 6:
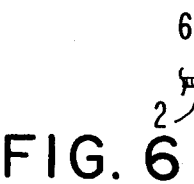
FIG. 6 is a side view of the anchor plate of the present invention showing the tying bore aligned to receive the string and the threads in the anchor bore.

A second means of anchoring the free end of the string requires anchor bore 6 to be threaded as shown in FIG. 6. In this embodiment the free end of the string is passed lengthwise through anchor slot 7 and threaded anchor screw 11 is tightened down into threaded anchor bore 6 until the string is vised between the bottom surface of threaded anchor bore 6 and the bottom surface of threaded anchor bolt 11.

In accordance with the present invention, tuning each individual string by turning its corresponding tuning knob does not impart any torque to said string, but rather imparts torque only to the corresponding anchor member. In this way the useful life of the string is extended by avoiding the application of any torque to the strings during the process of tuning the strings.

In accordance with the present invention, the anchoring and tuning mechanism permits the shortest possible overall string length and therefore the shortest possible instrument length, thus minimizing the material required to construct the instrument. Moreover, the shorter instrument is more convenient to hold and play and easier to transport and store.

For any given string, the vibratory length required to produce the desired note is that length between the bridge and the top fret of the neck of the stringed instrument. The length of string required for fastening the string beyond the bridge at one end and beyond the top fret at the other end constitutes the overhang length of string. The present invention minimizes the overhang length of string required for any given vibratory length of string. As known in the art, the shorter the overhang length of string, the better the tone produced by the instrument for any given musical note. Thus, the present invention results in improved tone for the musical notes produced by strings anchored and tuned by the present invention.

In embodiments of the invention for instruments having more than one string, adjacent channels share common sidewalls, as shown in FIGS. 2 and 10. In such embodiments the first sidewall of one channel also serves as first sidewall 25 of the next adjacent channel, and the second sidewall of one channel serves as second sidewall 26 of the next adjacent channel, as shown in FIGS. 2 and 10.

In accordance with an alternative embodiment of the present invention suitable for use with stringed instruments having a large number of strings with relatively loose string spacing, two or more anchor members may slide in the same channel.

In accordance with an alternative embodiment of the present invention suitable for use with stringed instruments having a large number of strings relative to the size of the hand-held instrument (this condition usually occurs when the instrument has more than six strings), knob 35 preferably has annular channels 42 separated by annular ribs 43 and arranged so that the annular rib of one knob interfits into the annular channel of the next adjacent knob and the annular channel of one knob interfits with the annular rib of the next adjacent knob, as shown in FIG. 12. Sufficient clearance exists between the annular channels and annular ribs of adjacent knobs so that any single knob can be turned manually without causing any rotation of either adjacent knob. This alternative embodiment is shown in FIGS. 12 and 13.

The anchorage arrangement employing threaded anchor bore 6 and threaded anchor bolt 11, as shown in FIG. 7, is preferably applied to anchor thicker strings, while the anchorage arrangement employing anchor slot 7 and tying bore 9, as shown in FIG. 8, is preferably applied to anchor thinner strings.

Means for fastening tuning block 23 to the base portion 38 of the stringed instrument are provided. Preferably these fastening means comprise countersunk threaded holes 39 through block 23 for receiving threaded screws which engage base portion 38 of the stringed instrument.

The tuning system of this invention is capable of maintaining its set tune for extended periods with little or no deviation, and the instrument may be shipped long distances without losing its tune. This is particularly advantageous for performing musicians.

It will be apparent to those skilled in the art that various modifications and variations could be made in the invention without departing from the scope or spirit of the invention.

What is claimed is:

1. A tuning system for a stringed musical instrument, the instrument having a body, a neck extending from said body, and a plurality of strings extending over at least a portion of said body each said string having a tuning end and a fixed end, the system comprising:

a tuning ball fastened to the tuning end of each said string;

an anchor ball fastened to the fixed end of each said string;

means for securing the fixed end of each said string to the neck of said instrument, said securing means including a plurality of longitudinal anchor slots on the neck of said instrument, the fixed end of each of said strings passing lengthwise through one of said anchor slots, said slots each having an open top and a pair of sides, each pair of sides having ends, the distance between said sides being smaller than the diameter of said anchor ball for manually inserting said string laterally through said open top into said slot and for securing said anchor ball in said slot against the ends of said sides when tension is imparted to the tuning end of said string;

a tuning block mounted on the body of said instrument adjacent said tuning end of the strings, said block having an individual tuning channel aligned with each string;

a plurality of anchor members, one of said anchor members being positioned in each of said channels;

means for biasing each said anchor member toward said neck;

a cut-out in the end of said of said anchor members closest said tuning end of the string for slidable insertion of said tuning ball, said cut-out having an exit slot for permitting the string to protrude through said end of said anchor member;

means for controllably adjusting the position of each said anchor member in its corresponding channel for increasing or decreasing the tension in a string of said instrument without imparting any substantial torque to said string, each said string being in substantially parallel alignment with each adjacent string throughout the entire length thereof; and bridge means mounted on said body of said instrument between said tuning block and said securing means.

2. The device of claim 1 wherein the adjusting means includes:

an individual tuning knob for each channel; and a plurality of threaded tuning bolts, one said bolt fixed on one end of each said knob and slidably mounted through said block in one of said tuning block channels, each said bolt extending into a tap longitudinally threaded in said anchor member.

3. The device of claim 2 wherein said biasing means includes a plurality of springs, one said spring surrounding each said tuning bolt for preventing longitudinal movement of said anchor member except in response to turning of said knobs.

4. The device of claim 2 wherein each of said tuning knobs is generally cylindrical, and the curved surface of each said knob includes annular ribs and annular channels, said ribs and channels being complementary for overlapping fit with adjacent knobs.

5. The device of claim 2 also including a tuning bore in each of said anchor members, the other end of each of said bolts slidably extending into one of said tuning bores and being peened to prevent said bolt from being extracted from said anchor member.

6. The device of claim 2 wherein said biasing means includes a plurality of springs, one of said springs being mounted between said tuning block and each said anchor member for biasing anchor members away from said tuning knobs.

7. The device of claim 1, wherein each said channel has opposing first and second sidewall and said first sidewall including a guideway for alignment with said cut-out, and said second sidewall including a stop for limiting the lateral movement of said tuning ball upon insertion into said cut-out.

8. The device of claim 3 wherein each said tuning ball is circular-shaped and has a circumferential groove, said one end of the string being looped around said groove, and said first opposing sidewall including a corresponding semi-circular-shaped guideway for guiding insertion of said circular-shaped ball into said cut-out.

9. The device of claim 1, wherein said securing means includes:

an anchor plate mounted to said neck, said anchor slots being located in said plate and each said slot extending perpendicular to and being aligned with one of said strings.

10. The device of claim 9 wherein said tuning balls and said anchor balls are of different sizes.

11. The device or claim 9 wherein the instrument is an electric guitar.

12. The device of claim 9 wherein each said anchor slot has a depression in the sides thereof for receiving said anchor ball when said fixed end of said string is inserted through said slot.

* * * * *